US006397949B1

(12) United States Patent
Walker et al.

(10) Patent No.: US 6,397,949 B1
(45) Date of Patent: Jun. 4, 2002

(54) METHOD AND APPARATUS FOR PRODUCTION USING A PRESSURE ACTUATED CIRCULATING VALVE

(75) Inventors: David Joseph Walker, Lafayette, LA (US); Dewayne Turner, Tomball, TX (US); William D. Henderson, League City, TX (US); Mike Ritter, The Woodlands, TX (US)

(73) Assignee: OSCA, Inc., Lafayette, LA (US)

( * ) Notice: Subject to any disclaimer, the term of this patent is extended or adjusted under 35 U.S.C. 154(b) by 0 days.

(21) Appl. No.: 09/378,384

(22) Filed: Aug. 20, 1999

Related U.S. Application Data

(60) Provisional application No. 60/097,449, filed on Aug. 21, 1998.

(51) Int. Cl.[7] ..... E21B 34/10; E21B 43/12

(52) U.S. Cl. ..... 166/374; 166/320; 166/323; 166/334.1

(58) Field of Search ..... 166/319, 320, 166/321, 323, 332.1, 334.1, 373, 374

(56) References Cited

U.S. PATENT DOCUMENTS

| | | | | | |
|---|---|---|---|---|---|
| 3,749,119 | A | * | 7/1973 | Tausch et al. | 137/461 |
| 3,823,773 | A | * | 7/1974 | Nutter | 166/336 |
| 3,845,815 | A | * | 11/1974 | Garwood | 166/154 |
| 3,970,147 | A | * | 7/1976 | Jesup et al. | 166/250 |
| 3,993,130 | A | * | 11/1976 | Papp | 166/330 |
| 4,383,578 | A | * | 5/1983 | Baker | 166/373 |
| 4,749,044 | A | * | 6/1988 | Skipper et al. | 166/323 |
| 4,967,845 | A | * | 11/1990 | Shirk | 166/386 |
| 5,609,204 | A | | 3/1997 | Rebardi et al. | 166/51 |
| 5,676,208 | A | * | 10/1997 | Finely | 166/278 |

* cited by examiner

*Primary Examiner*—David Bagnell
*Assistant Examiner*—Jennifer H Gay
(74) *Attorney, Agent, or Firm*—Baker Botts L.L.P.

(57) ABSTRACT

The present invention relates to a pressure actuated valve for use in well completion assemblies. The valve is operable by pressure between three configurations. In a first configuration, the valve is in a locked-closed configuration. In a second configuration, the valve remains closed but is unlocked. In a third configuration, the valve is open. Also disclosed is a method of installing and operating a three pressure actuated valve in a well completion operation.

19 Claims, 5 Drawing Sheets

11
13
44
46
21
14
66
90
A

A
B
11
12
13
14
16
20
21
22
24
42
43
44
46
69
80
82
84
90

SECTION 'A-A'

METHOD AND APPARATUS FOR PRODUCTION USING A PRESSURE ACTUATED CIRCULATING VALVE

REFERENCE TO PRIOR APPLICATION

This application claims the benefit of U.S. Provisional Application No. 60/097,449, filed Aug. 21, 1998.

BACKGROUND OF THE INVENTION

The present invention relates to the field of well completion assemblies for use in a wellbore. More particularly, the invention provides an improved pressure actuated valve for production zone isolation.

The present invention provides an isolation sleeve assembly which may be installed inside a production screen and thereafter controlled by generating a pressure differential between the valve interior and exterior. In contrast, prior systems required the use of a service string, wire line, coil tubing, or other implement to control the configuration of the isolation valves. Utilization of such systems involves positioning of tools down-hole. Each trip into the wellbore adds additional expense to the well owner and increases the possibility that tools may become lost in the wellbore requiring still further operations for their retrieval.

While pressure actuated valves have been used in certain situations, disadvantages have been identified with such devices. For example, prior pressure actuated valves had only a closed position and an open position. Thus, systems could not reliably use more than one such valve, since the pressure differential utilized to shift the first valve from the closed position to the open would be lost once the first valve was opened. Therefore, there could be no assurance all valves in a system would open.

There has therefore remained a need for an isolation system for well control purposes and for wellbore fluid loss control, which combines simplicity, reliability, safety and economy, while also affording flexibility in use. The present invention satisfies this need, providing an isolation system which does not require tools to shift the valve and allows the use of multiple pressure actuated valves in a production assembly.

SUMMARY OF THE INVENTION

Briefly describing one aspect of the present invention, there is provided an isolation assembly which comprises a production string having an interior annulus and an exterior. The production string includes at least one aperture providing fluid communication between the exterior and the interior annulus. Further, a pressure actuated valve is disposed adjacent the aperture. The valve is shiftable by changes in pressure between a locked-closed configuration, an unlocked-closed configuration and an open configuration. In a preferred embodiment, the valve assembly further includes a mechanism for biasing the valve into the open configuration after it has been shifted to the unlocked-closed configuration. In still a further aspect of a preferred embodiment, the valve assembly includes inner and outer sleeves axially displaceable by the generation of a pressure differential between the interior of the production tubing and the exterior. In a preferred embodiment, the inner and outer sleeves define a chamber for transferring a pressure differential into a force acting along the longitudinal axis to urge axial displacement of one sleeve with respect to the other.

The present invention further contemplates the use of a plurality of valves according to the present invention within a single screen assembly and that there may be multiple screen assemblies. Also, if desired to reduce costs of an assembly, a single dump valve having only an open and closed position may be combined with valves of the present design. In such an assembly the pressure differential required to shift the valves from the locked-closed configuration to the unlocked-closed configuration would be less than the pressure required to shift the dump valve to the open position.

Further, valves of the present design may be used in conjunction with known gravel packing and isolation systems. In this manner, gravel packing the formation may be conducted in a standard manner and the formation isolated. Once this is completed, the formation may be brought on-line without running tools back into the wellbore simply by pressuring up the interior of the tubing to open any number of valves according to the present invention.

The present invention further contemplates a method of inserting production tubing, comprising providing a production tubing assembly including a screen, and a pressure actuated isolation valve disposed adjacent the screen. The assembly is inserted into a wellbore until the screen and isolation valve are disposed adjacent a production zone. In a preferred embodiment the isolation valve is initially in a closed configuration, however, it is contemplated that the valve may be manipulated into such a configuration after placement. When desired, a pressure differential is created between the exterior of the production tubing and the interior, the pressure differential tends to shift the pressure actuated valve from a locked-closed configuration to an unlocked-closed configuration. Thus, in the first valve shifting operation the valve stays in a continuously closed state. In a preferred embodiment, the pressure in the tubing is initially increased with respect to the pressure surrounding the production assembly to move the valve to an unlocked, yet closed configuration. Once unlocked, the pressure differential is decreased to allow the valve to move to an open configuration to permit fluid flow through the production screen. In multiple zone completions, the method may preferably include passing a further production tubing string through the isolation valve to reach a lower production zone. It will be understood that the pressure actuated valve of the present invention may be actuated with such a second production tubing in place in the wellbore.

It is an object of the present invention to provide a versatile isolation system that combines simplicity, reliability, safety, and economy with optional methods of operation.

Another object of the present invention is to provide an isolation valve that may be shifted without the use of tools inserted into the wellbore.

Still another object of the present invention is to provide an isolation system that may be permanently installed inside the production screen at the surface prior to running into the well.

Yet a further object of the present invention is to provide a pressure actuated valve that may be used in conjunction with a plurality of similar valves to provide reliable shifting of all valves simultaneously.

It is a further object to provide an isolation system which is simpler to install and operate, and which provides immediate access to a zone of interest.

According to one aspect of the invention, there is provided a valve for a production assembly for the production of minerals from a well, the valve having a tube having at least one opening; a sleeve having at least one other opening and being movably connected to the tube, wherein the tube and sleeve are configurable in at least locked-closed, unlocked-closed and open configurations, wherein the at least one opening and the at least one other opening are adjacent in the open configuration and nonadjacent in the locked-closed and unlocked-closed configurations; and a chamber between the tube and the sleeve, wherein a pressure within the chamber unlocks the lock and configures the tube and sleeve between the locked-closed and unlocked-closed configurations.

According to a further aspect of the invention, there is provided a valve for a production assembly for the production of minerals from a well, the valve having: a tube having at least one hole; a sleeve, wherein the sleeve and tube are configurable between at least locked-closed, unlocked-closed and open configurations, wherein the sleeve shuts the at least one hole in the locked-closed and unlocked-closed configurations and the sleeve opens the at least one hole in the open configuration; and a pressure activated control mechanism.

According to still another aspect of the invention, there is provided a production assembly for producing mineral from a production zone, the assembly having: a production string; a production screen; a valve having: a tube having at least one hole; a sleeve, wherein the tube and sleeve are configurable between at least locked-closed, unlocked-closed and open configurations, wherein the sleeve shuts the at least one hole in the locked-closed and unlocked-closed configurations and the sleeve opens the at least one hole in the open configuration; and a pressure activated control mechanism.

According to another aspect of the invention, there is provided a method for producing mineral from a production zone, the method having the steps of: placing a production assembly adjacent the production zone, wherein the production assembly having: a production pipe; a production valve comprising: a tube having at least one hole; a sleeve, wherein the tube and sleeve are configurable between at least locked-closed, unlocked-closed and open configurations, wherein the sleeve shuts the at least one hole in the locked-closed and unlocked-closed configurations and the sleeve opens the at least one hole in the open configuration; and a pressure activated control mechanism which reconfigures the sleeve and tube between the locked-closed configuration and the unlocked-closed configuration; inducing a pressure differential between an interior of the production assembly and an exterior of the production assembly, wherein the pressure differential is sufficient to activate the pressure activated control mechanism.

Further objects and advantages of the present invention will be apparent from the description of the preferred embodiment which follows.

BRIEF DESCRIPTION OF THE DRAWINGS

The present invention is better understood by reading the following description of non-limitative embodiments with reference to the attached drawings wherein like parts in each of the several figures are identified by the same reference characters, and which are briefly described as follows.

Figures 1A, 1B, 2A, 2B, 3A, 3B:
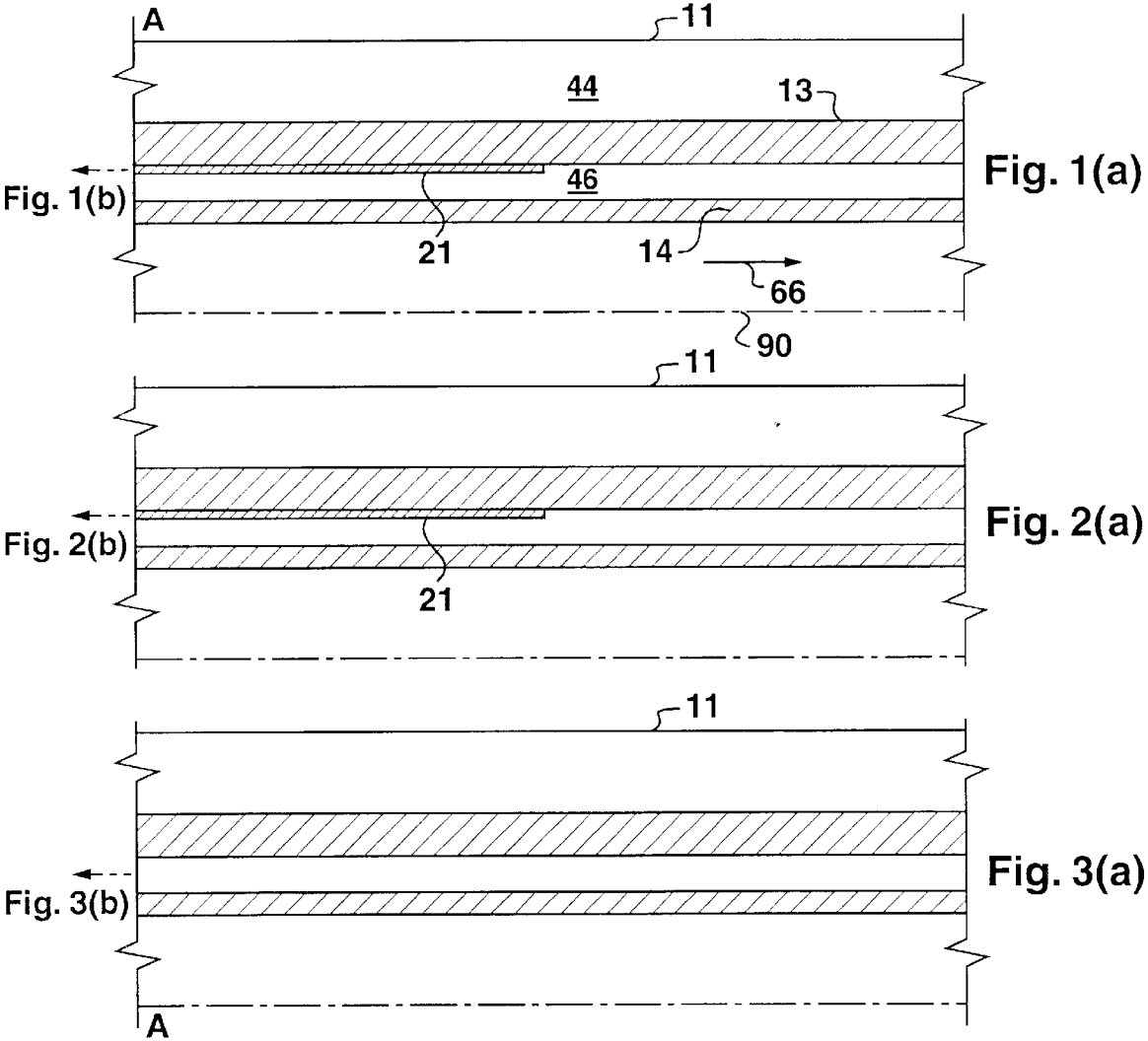
FIGS. 1 (*a*) through (*d*) are a side, partial cross-sectional, diagrammatic view of half of a production tubing assembly in accordance with the present invention in a locked-closed configuration. It will be understood that the cross-sectional view of the other half of the production tubing assembly is a mirror image taken along the longitudinal axis.
FIGS. 2 (*a*) through (*d*) illustrate the isolation system of FIG. 1 in an unlocked-closed configuration.
FIGS. 3 (*a*) through (*d*) illustrate the isolation system of FIG. 2 in an open configuration.

It is to be noted, however, that the appended drawings illustrate only typical embodiments of this invention and are therefore not to be considered limiting of its scope, as the invention may admit to other equally effective embodiments.

DETAILED DESCRIPTION OF THE INVENTION

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

In accordance with the present invention, an isolation system with a unique pressure actuated valve is provided which may be installed prior to running the system into the wellbore. This yields a simpler and easier installation with advantages also in respect to the subsequent operation of the system. A valve system is mounted within the production screen and forms an integral part of the assembly, thereby avoiding the need for a separate isolation system to be run separately into the well. However, a valve assembly according to the present invention may be run into the wellbore and placed adjacent a production zone in a subsequent operation.

Figures 1A, 1B, 1C, 2A, 2B, 2C, 3A, 3B, 3C:
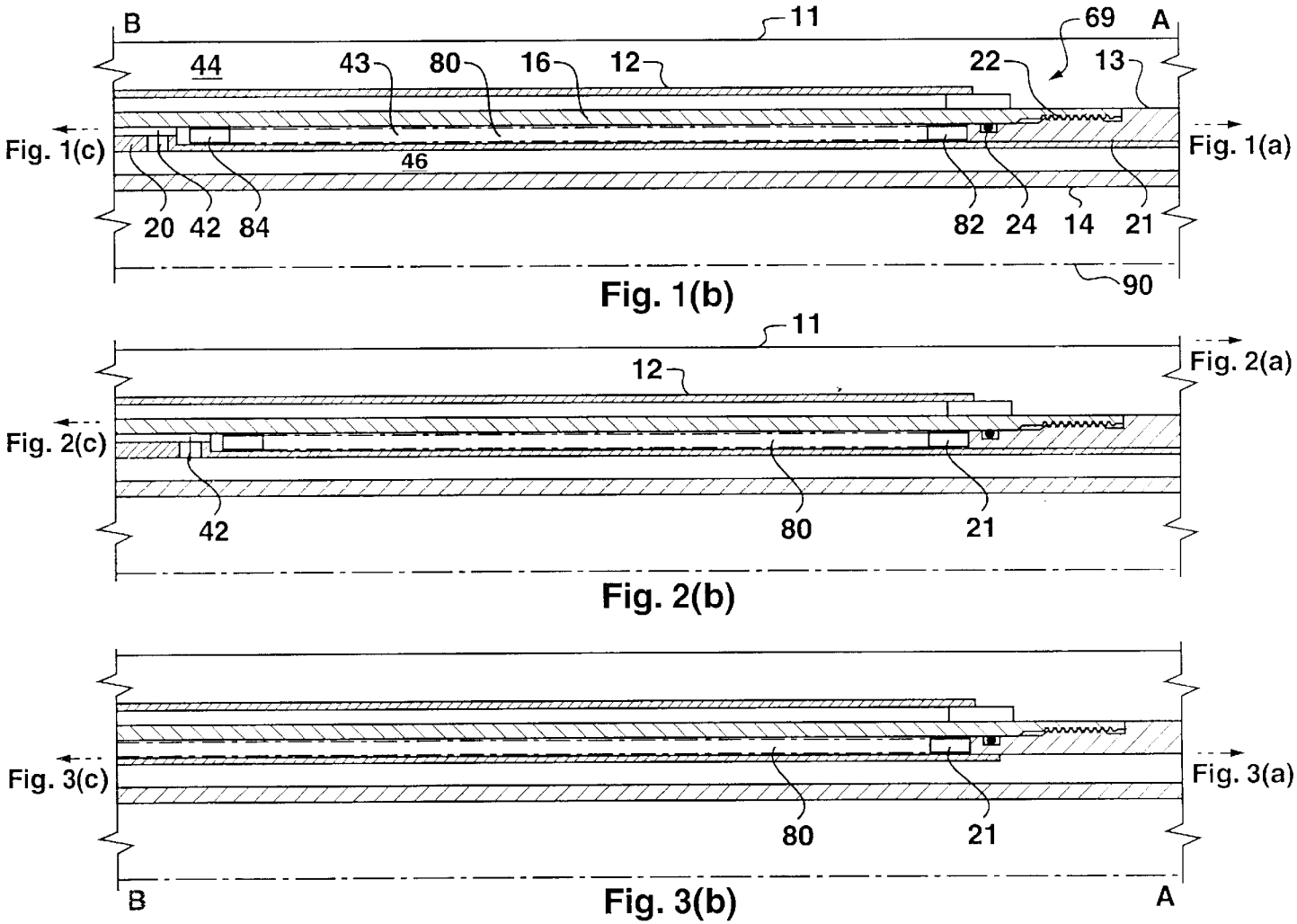
Figure 1C:
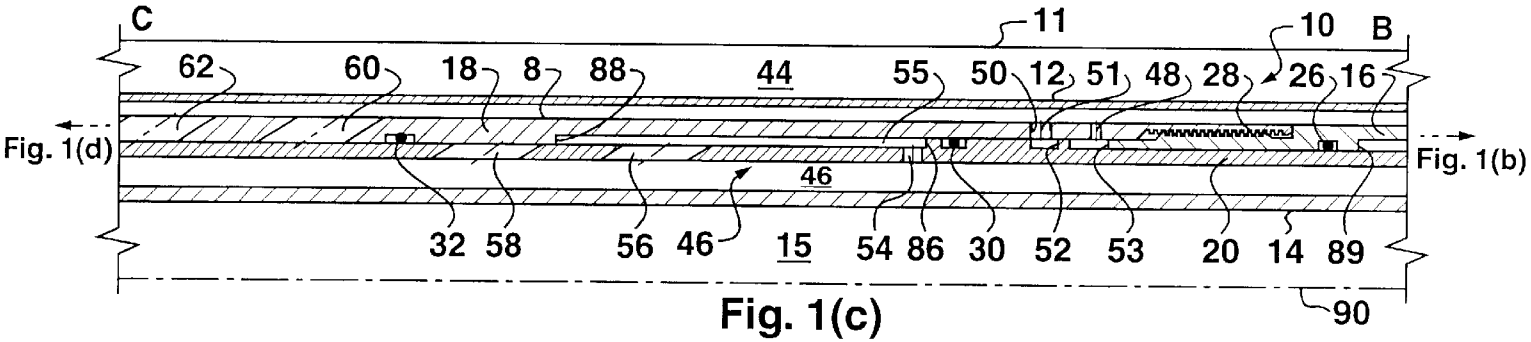
Figure 1D:
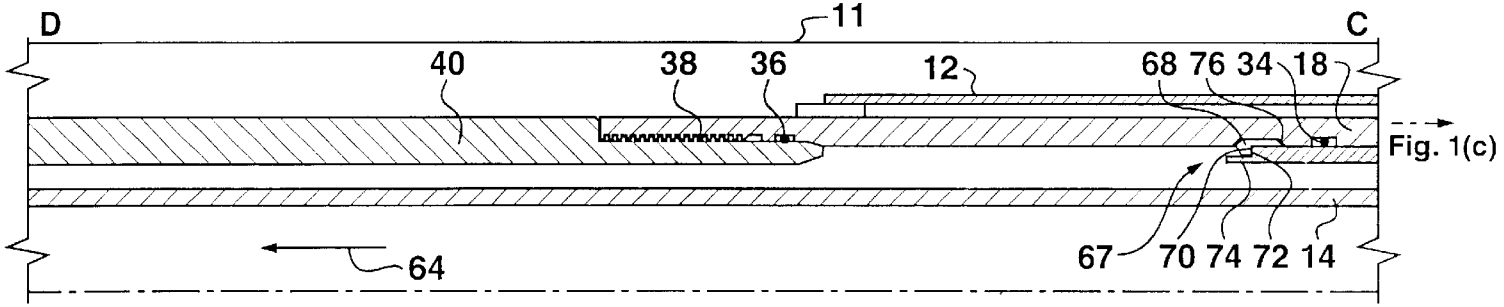

Referring to FIGS. 1 (*a*) through (*d*), there is shown a production tubing assembly 10 according to the present invention. The production tubing assembly 10 is mated in a conventional manner and will only be briefly described herein. Assembly 10 includes production pipe 40 that extends to the surface and a production screen assembly 12 with integral isolation valve assembly 8 controlling fluid flow through the screen assembly. In a preferred embodiment production screen assembly 12 is mounted on the exterior of isolation valve assembly 8. Isolation valve assembly 8 is interconnected with production tubing 40 at the uphole end by threaded connection 38 and seal 36. Similarly on the downhole end 69, isolation valve assembly 8 is interconnected with production tubing extension 13 by threaded connection 22 and seal 24. In the views shown, the production tubing assembly 10 is disposed in well casing 11 and has inner tubing 14, with an internal bore 15, extending through the inner bore 46 of the assembly.

The production tubing assembly 10 illustrates a single preferred embodiment of the invention. However, it is contemplated that the isolation valve assembly according to the present invention may have uses other than at a production zone and may be mated in combination with a wide variety of elements as understood by a person skilled in the art. Further, while only a single isolation valve assembly is shown, it is contemplated that a plurality of such valves may be placed within the production screen depending on the length of the producing formation and the amount of redundancy desired. Moreover, although an isolation screen is disclosed in the preferred embodiment, it is contemplated that the screen may include any of a variety of external or internal filtering mechanisms including but not limited to screens, sintered filters, and slotted liners. Alternatively, the isolation valve assembly may be placed without any filtering mechanisms.

Referring now more particularly to isolation valve assembly 8, there is shown outer sleeve upper portion 18 joined with an outer sleeve lower portion 16 by threaded connection 28. For the purpose of clarity in the drawings, these openings have been shown at a 45° inclination. Outer sleeve upper portion 18 includes two relatively large production openings 60 and 62 for the flow of fluid from the formation when the valve is in an open configuration. Outer sleeve upper portion 18 also includes through bores 48 and 50. Disposed within bore 50 is shear pin 51, described further below. The outer sleeve assembly has an outer surface and an internal surface. On the internal surface, the outer sleeve upper portion 18 defines a shoulder 88 (FIG. 1(*c*)) and an area of reduced wall thickness extending to threaded connection 28 resulting in an increased internal diameter between shoulder 88 and connection 28. Outer sleeve lower portion 16 further defines internal shoulder 89 and an area of reduced internal wall thickness extending between shoulder 89 and threaded connection 22. Adjacent threaded connection 38, outer sleeve portion 18 defines an annular groove 76 adapted to receive a locking ring 68.

Disposed within the outer sleeves is inner sleeve 20. Inner sleeve 20 includes production openings 56 and 58 which are sized and spaced to correspond to production openings 60 and 62, respectively, in the outer sleeve when the valve is in an open configuration. Inner sleeve 20 further includes relief bores 54 and 42. On the outer surface of inner sleeve there is defined a projection defining shoulder 86 and a further projection 52. Further inner sleeve 20 includes a portion 21 having a reduced external wall thickness. Portion 21 extends down hole and slidably engages production pipe extension 13. Adjacent uphole end 67, inner sleeve 20 includes an area of reduced external diameter 74 defining a shoulder 72.

In the assembled condition shown in FIGS. 1(*a*) through (*d*), inner sleeve 20 is disposed within outer sleeves 16 and 18, and sealed thereto at various locations. Specifically, on either side of production openings 60 and 62, seals 32 and 34 seal the inner and outer sleeves. Similarly, on either side of shear pin 51, seals 26 and 30 seal the inner sleeve and outer sleeve. The outer sleeves and inner sleeve combine to form a first chamber 55 defined by shoulder 88 of outer sleeve 18 and by shoulder 86 of the inner sleeve. A second chamber 43 is defined by outer sleeve 16 and inner sleeve 20. A spring member 80 is disposed within second chamber 43 and engages production tubing 13 at end 82 and inner sleeve 20 at end 84. A lock ring 68 is disposed within recess 76 in outer sleeve 18 and retained in the recess by engagement with the exterior of inner sleeve 20. Lock ring 68 includes a shoulder 70 that extends into the interior of the assembly and engages a corresponding external shoulder 72 on inner sleeve 20 to prevent inner sleeve 20 from being advanced in the direction of arrow 64 beyond lock ring 68 while it is retained in groove 76.

Figure 2C:
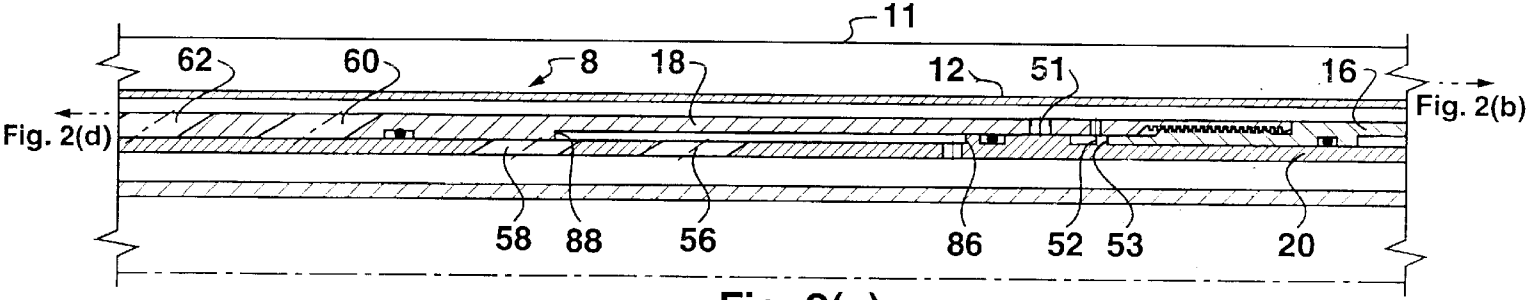
Figure 3C:
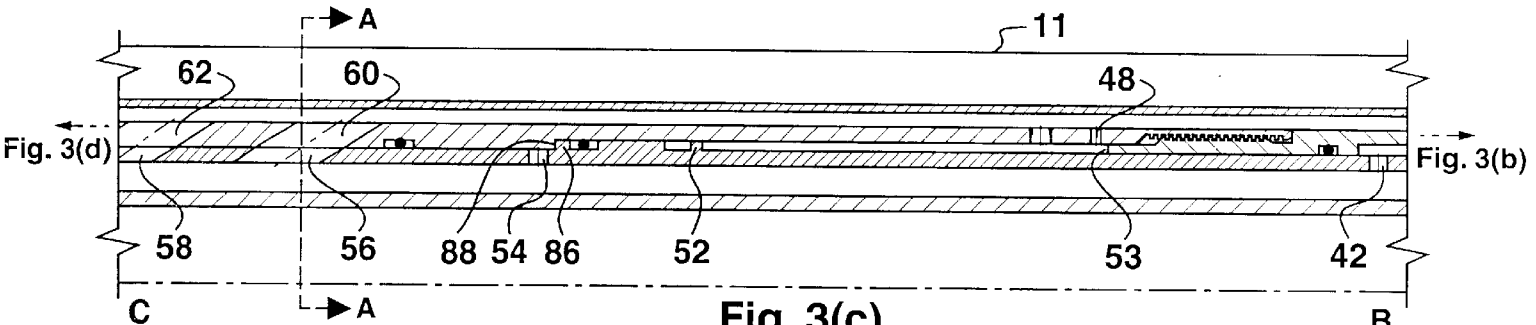
Figure 2D:
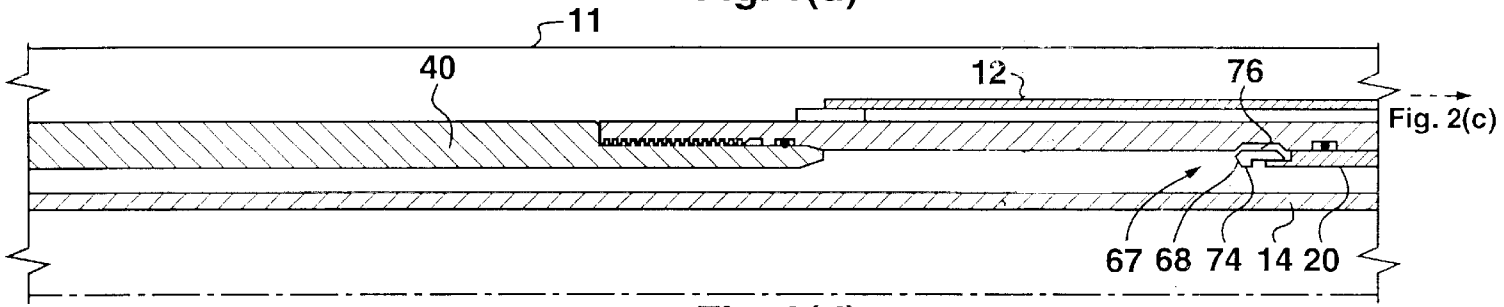
Figure 3D:
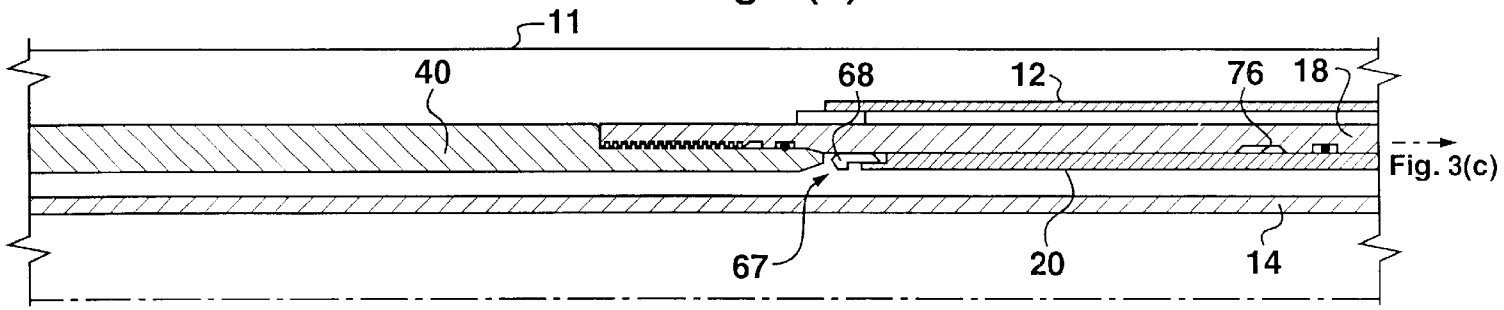
Figure 4:
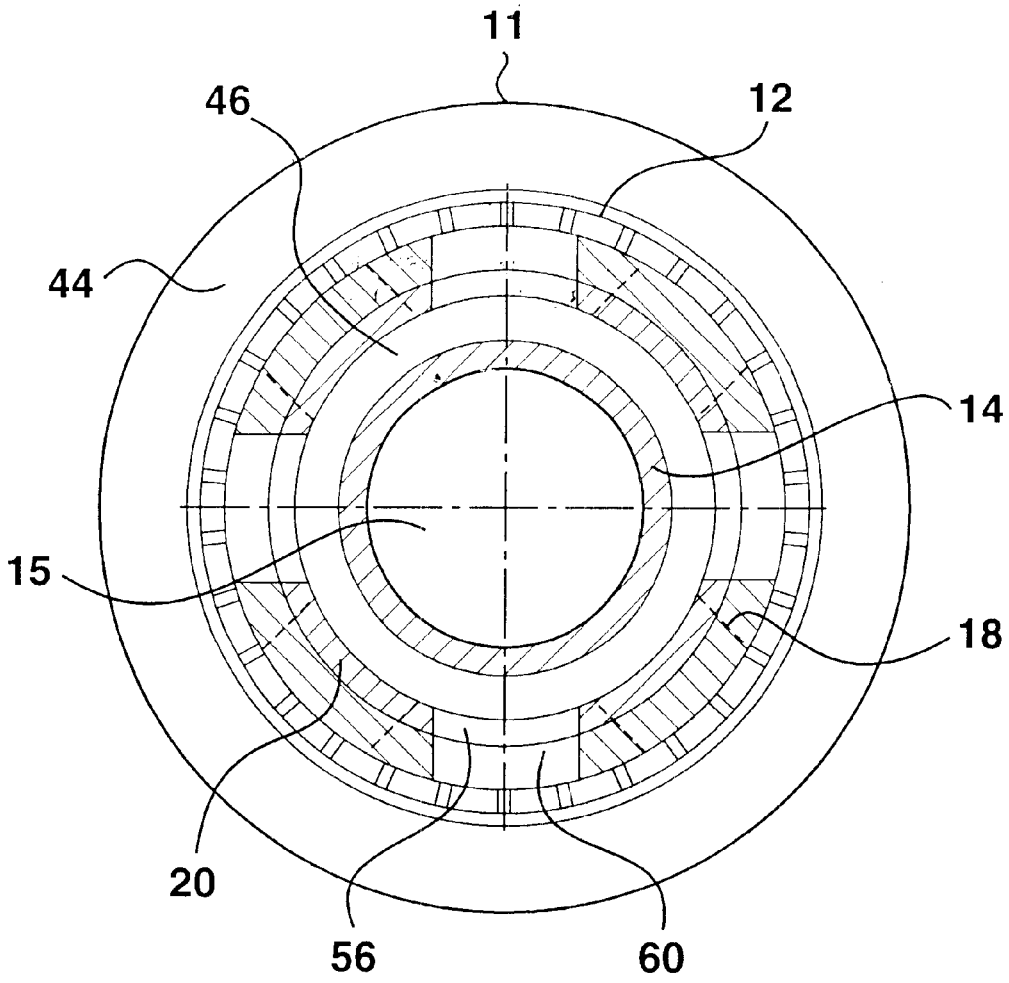
FIG. 4 is a cross-sectional, diagrammatic view taken along line A—A of FIG. 3(*c*) showing the full assembly.

The valve assembly of the present invention has three configurations as shown in FIGS. 1 through 3. In a first configuration shown in FIG. 1, the production openings 56 and 58 in inner sleeve 20 are axially spaced from production openings 60 and 62 along longitudinal axis 90. Thus, valve assembly 8 is closed and restricts flow through screen 12 into the interior of the production tubing. The inner sleeve is locked in the closed configuration by a combination of lock ring 68 which prevents movement of inner sleeve 20 up hole in the direction of arrow 64 to the open configuration. Movement down hole is prevented by shear pin 51 extending through bore 50 in the outer sleeve and engaging an annular recess in the inner sleeve. Therefore, in this position the inner sleeve is in a locked closed configuration.

In a second configuration shown in FIG. 2, shear pin 51 has been severed and inner sleeve 20 has been axially displaced down hole in relation to the outer sleeve in the direction of arrow 66 until external shoulder 52 on the inner sleeve engages end 53 of outer sleeve 16. The production openings of the inner and outer sleeves continue to be axial displaced to prevent fluid flow therethrough. With the inner sleeve axial displaced down hole, lock ring 68 is disposed adjacent reduced outer diameter portion 74 of inner sleeve 20 such that the lock ring may contract to a reduced diameter configuration. In the reduced diameter configuration shown in FIG. 2, lock ring 68 may pass over recess 76 in the outer sleeve without engagement therewith. Therefore, in this configuration, inner sleeve is in an unlocked position.

In a third configuration shown in FIG. 3, inner sleeve 20 is axially displaced along longitudinal axis 90 in the direction of arrow 64 until production openings 56 and 58 of the inner sleeve are in substantial alignment with production openings 60 and 62, respectively, of the outer sleeve. Axial displacement is stopped by the engagement of external shoulder 86 with internal shoulder 88. In this configuration, valve assembly 8 is in an open position.

In the operation of a preferred embodiment, at least one isolation valve according to the present invention is mated with production screen 12 and, production tubing 13 and 40, to form production assembly 10. The production assembly according to FIG. 1 with the isolation valve in the locked-closed configuration, is then inserted into casing 11 until it is positioned adjacent a production zone (not shown). When access to the production zone is desired, a predetermined pressure differential between the casing annulus 44 and internal annulus 46 is established to shift inner sleeve 20 to the unlocked-closed configuration shown in FIG. 2. It will be understood that the amount of pressure differential required to shift inner sleeve 20 is a function of the force of spring 80, the resistance to movement between the inner and outer sleeves, and the shear point of shear pin 51. Thus, once the spring force and resistance to movement have been overcome, the shear pin determines when the valve will shift. Therefore, the shifting pressure of the valve may be set at the surface by inserting shear pins having different strengths.

A pressure differential between the inside and outside of the valve results in a greater amount of pressure being applied on external shoulder 86 of the inner sleeve than is applied on projection 52 by the pressure on the outside of the valve. Thus, the internal pressure acts against shoulder 86 of to urge inner sleeve 20 in the direction of arrow 66 to sever shear pin 51 and move projection 52 into contact with end 53 of outer sleeve 16. It will be understood that relief bore 48 allows fluid to escape the chamber formed between projection 52 and end 53 as it contracts. In a similar fashion, relief bore 42 allows fluid to escape chamber 43 as it contracts during the shifting operation. After inner sleeve 20 has been shifted downhole, lock ring 68 may contract into the reduced external diameter of inner sleeve positioned adjacent the lock ring. Often, the pressure differential will be maintained for a short period of time at a pressure greater than that expected to cause the down hole shift to ensure that the shift has occurred. This is particularly important where more than one valve according to the present invention is used since once one valve has shifted to an open configuration in a subsequent step, a substantial pressure differential is difficult to establish.

The pressure differential is removed, thereby decreasing the force acting on shoulder 86 tending to move inner sleeve 20 down hole. Once this force is reduced or eliminated, spring 80 urges inner sleeve 20 into the open configuration shown in FIG. 3. Lock ring 68 is in a contracted state and no longer engages recess 76 such the ring now slides along the inner surface of the outer sleeve. In a preferred embodiment spring 80 has approximately 300 pounds of force in the compressed state in FIG. 2. However, varying amounts of force may be required for different valve configurations. Moreover, alternative sources other than a spring may be used to supply the force for opening. As inner sleeve 20 moves to the open configuration, relief bore 54 allows fluid to escape chamber 55 as it is contracted, while relief bores 48 and 42 allow fluid to enter the connected chambers as they expand.

Although only a single preferred embodiment of the invention has been shown and described in the foregoing description, numerous variations and uses of a valve according to the present invention are contemplated. As examples of such modification, but without limitation, the valve connections to the production tubing may be reversed such that the inner sleeve moves down hole to the open configuration. In this configuration, use of a spring 80 may not be required as the weight of the inner sleeve may be sufficient to move the valve to the open configuration. Further, the inner sleeve may be connected to the production tubing and the outer sleeve may be slidable disposed about the inner sleeve. A further contemplated modification is the use of an internal mechanism to engage a shifting tool to allow tools to manipulate the valve if necessary. In such a configuration, locking ring 68 may be replaced by a moveable lock that could again lock the valve in the closed configuration. Alternatively, spring 80 may be disengageable to prevent automatic reopening of the valve.

Further, use of a valve according to the present invention is contemplated in many systems. One such system is the ISO System offered by OSCA, Inc. and described in U.S. Pat. No. 5,609,204, the disclosure therein is hereby incorporated by reference. A tool shiftable valve may be utilized within the production screens to accomplish the gravel packing operation. Such a valve could be closed as the crossover tool string is removed to isolate the formation. The remaining production valves adjacent the production screen may be pressure actuated valves according to the present invention such that inserting a tool string to open the valves is unnecessary.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

We claim:

1. A valve for a production assembly for the production of minerals from a well, the valve comprising:

a tube having at least one opening;

a sleeve having at least one other opening and being movably connected to said tube, wherein said tube and sleeve are configurable in at least locked-closed, unlocked-closed and open configurations, wherein the at least one opening and the at least one other opening are adjacent in the open configuration and nonadjacent in the locked-closed and unlocked-closed configurations;

a lock between said sleeve and said tube which locks the sleeve and tube in the locked-closed configuration; and a chamber between said tube and said sleeve, wherein a pressure within said chamber unlocks said lock and configures said tube and sleeve between the locked-closed and unlocked-closed configurations.

2. A valve as in claim 1, wherein said sleeve is concentric within said tube.

3. A valve as in claim 1, wherein said chamber comprises an outlet which fluidly communicates with an interior of said tube.

4. A valve as in claim 1, wherein said chamber comprises an outlet which fluidly communicates with a casing annulus.

5. A valve as in claim 1, wherein said lock is a ring which is disposed in a reduced diameter portion of said sleeve in an unlocked configuration and is disposed in a groove of said tube in a locked configuration.

6. A valve as in claim 1, wherein said lock is a shear pin.

7. A valve as in claim 1, wherein said lock is lockable when said tube and sleeve are reconfigured from the unlocked-closed and open configurations to the locked-closed configuration.

8. A valve as in claim 1, further comprising a biasing mechanism which biases said tube and sleeve to the open configuration.

9. A valve as in claim 8, wherein said biasing mechanism is a spring which engages said tube and said sleeve.

10. A valve as in claim 8, wherein said biasing mechanism is a biasing chamber between said tube and said sleeve.

11. A valve as in claim 8, wherein said biasing mechanism is a gravity driven configuration of said tube and sleeve.

12. A valve for a production assembly for the production of minerals from a well, the valve comprising:

a tube having at least one hole;

a sleeve, wherein said sleeve and tube are configurable between at least locked-closed, unlocked-closed and open configurations, wherein the sleeve shuts the at least one hole in the locked-closed and unlocked-closed configurations and the sleeve opens the at least one hole in the open configuration; and a pressure activated control mechanism, wherein said pressure activated control mechanism reconfigures the sleeve and tube between the locked-closed configuration and the unlocked-closed configuration.

13. A valve as claimed in claim 12, further comprising a biasing mechanism which biases the tube and sleeve to the open configuration.

14. A production assembly for producing mineral from a production zone, said assembly comprising:

a production string;

a production screen;

a valve comprising:

a tube having at least one hole;

a sleeve, wherein said tube and sleeve are configurable between at least locked-closed, unlocked-closed and open configurations, wherein the sleeve shuts the at least one hole in the locked-closed and unlocked-closed configurations and the sleeve opens the at least one hole in the open configuration; and a pressure activated control mechanism.

15. A production assembly as claimed in claim 14, wherein said valve comprises a plurality of valves.

16. A valve as claimed in claim 15, wherein said pressure activated control mechanism of each valve of said plurality of valves reconfigures each sleeve and tube between the locked-closed configuration and the unlocked-closed configuration.

17. A valve as claimed in claim 15, wherein each valve of said plurality of valves further comprises a biasing mechanism which biases each tube and sleeve to the open configuration.

18. A method for producing mineral from a production zone, said method comprising:

placing a production assembly adjacent the production zone, wherein the production assembly comprises:

a production pipe;

a production valve connected to said production pipe and comprising:

a tube having at least one hole, a sleeve, wherein said tube and sleeve are configurable between at least locked-closed, unlocked-closed and open configurations, wherein the sleeve shuts the at least one hole in the locked-closed and unlocked-closed configurations and the sleeve opens the at least one hole in the open configuration; and a pressure activated control mechanism which reconfigures the sleeve and tube between the locked-closed configuration and the unlocked-closed configuration;

inducing a pressure differential between an interior of the production assembly and an exterior of the production assembly, wherein said pressure differential is sufficient to activate the pressure activated control mechanism.

19. A method as claimed in claim 18, wherein said valve further comprises a biasing mechanism which biases the tube and sleeve to the open configuration, and wherein said method further comprises releasing the pressure differential to allow the biasing mechanism to configure the sleeve and tube to the open configuration.

* * * * *